US008088987B2

(12) United States Patent
Takashima

(10) Patent No.: US 8,088,987 B2
(45) Date of Patent: Jan. 3, 2012

(54) TONE SIGNAL PROCESSING APPARATUS AND METHOD

(75) Inventor: Motoaki Takashima, Nagoya (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/902,718

(22) Filed: Oct. 12, 2010

(65) Prior Publication Data

US 2011/0088534 A1 Apr. 21, 2011

(30) Foreign Application Priority Data

Oct. 15, 2009 (JP) ..... 2009-238082

(51) Int. Cl.
*G10H 1/36* (2006.01)
*G10H 7/00* (2006.01)

(52) U.S. Cl. ..... 84/610; 84/626

(58) Field of Classification Search ..... 84/610, 84/626, 634, 662
See application file for complete search history.

(56) References Cited

U.S. PATENT DOCUMENTS 5,719,346 A * 2/1998 Yoshida et al. ..... 84/631
5,902,951 A 5/1999 Kondo et al.
6,816,833 B1 11/2004 Iwamoto et al.
7,420,113 B2 * 9/2008 Ohno ..... 84/609
2008/0223200 A1 9/2008 Kwak

FOREIGN PATENT DOCUMENTS

EP 0 913 808 A1 5/1999
JP 11-133954 A 5/1999
JP 2005-107315 A 4/2005

OTHER PUBLICATIONS

Extended European Search Report issued in corresponding European Patent Application No. 10187529.2 dated Feb. 25, 2011.

* cited by examiner

*Primary Examiner* — Jeffrey Donels
(74) *Attorney, Agent, or Firm* — Rossi, Kimms & McDowell LLP

(57) ABSTRACT

Specific pitch of an input tone signal is sequentially detected, and a normalized pitch corresponding to a pitch name is sequentially detected on the basis of the specific pitch. It is determined whether there has been a variation in the detected pitch. Lead tone (first tone signal) is generated on the basis of the input tone signal, and a harmony tone (second tone signal) is generated on the basis of the detected pitch. When it is determined that there has been a variation in the pitch, processing waits until a predetermined time passes, and control is performed to change a pitch of the second tone signal if a pitch detected immediately before the variation and a current detected pitch are determined to be different from each other upon the passage of the predetermined time.

15 Claims, 3 Drawing Sheets

| LEADING TONE | HARMONY TONE 1 | HARMONY TONE 2 |
|---|---|---|
| C | E (0) | G (0) |
| C# | E (0) | G (0) |
| D | G (0) | C (+1) |
| D# | G (0) | C (+1) |
| E | G (0) | C (+1) |
| F | C (+1) | E (+1) |
| F# | C (+1) | E (+1) |
| G | C (+1) | E (+1) |
| G# | C (+1) | E (+1) |
| A | C (+1) | E (+1) |
| A# | C (+1) | E (+1) |
| B | E (+1) | G (+1) |

TONE SIGNAL PROCESSING APPARATUS AND METHOD

BACKGROUND

The present invention relates to a tone signal processing apparatus and method for generating not only a lead note or tone on the basis of an input tone or voice but also an additional tone harmonious with the lead tone. More particularly, the present invention relates to a technique which, when a tone, voice or the like, frequently varying in pitch within a short time period, has been input, generates an additional tone that does not fluctuate in tone pitch (hereinafter also referred to as "pitch") and thus has a sense of auditorily calm stability. The tone signal processing apparatus and method of the present invention are applicable to human-voice or musical-instrument-tone processing systems belonging to music-related equipment, such as karaoke apparatus, electronic musical instruments and personal computers.

Heretofore, there have been known tone signal processing apparatus and methods having a tone generation function which detects a pitch of a tone signal of an input tone, voice (typically, human voice) or the like (ultimately, detects a particular pitch corresponding to any one of the musical pitch names) to generate a tone signal of a lead tone (first tone signal) of the detected pitch, and which also separately determines a pitch (corresponding to any one of the musical pitch names) on the basis of the detected pitch and chord information input via a keyboard or the like to thereby automatically generate a tone signal of a harmony note or tone (second tone signal) of the determined pitch as a separate additional tone with the generated lead tone as a main tone. One example of such tone signal processing apparatus is disclosed in Japanese Patent Application Laid-open Publication No. HEI-11-133954 (hereinafter referred to as "the prior patent literature"). It should be appreciated that the term "tone signal" is used herein to refer to a signal of a voice or any other desired sound rather than being limited to a signal of a musical tone.

The following describe a conventionally-known tone generation processing procedure employed in the apparatus disclosed in the above-identified prior patent literature, with reference to FIG. 5. FIG. 5 is a conceptual diagram explanatory of the tone generation processing procedure, where the vertical axis represents frequency while the horizontal axis represents time. More specifically, FIG. 5 shows, on its left side section, a flow of processes performed in the apparatus and shows, on its right side section, variations of a signal waveform occurring in response to execution of the individual processes. Further, FIG. 6 is a conceptual diagram showing a data organization of a conventionally-known tone pitch determination table that is referenced in determining a pitch of a harmony tone as will be later described.

First, a sound signal input via a microphone or the like is subjected to a "frequency detection" process, where the input sound signal is converted into a frequency signal. Because this frequency detection" process may be performed using any desired conventionally-known technique, such as the zero-cross method well known in the field of sound analyses, a detailed description of this frequency detection process will be omitted. Then, the frequency signal is subjected to a "smoothing" process, where variations in the frequency signal are smoothed. Then, the smoothed frequency signal is subjected to a "pitch name detection" process, where the smoothed frequency signal is discretized, every predetermined time interval, into any one of pitch names of a twelve-note scale (i.e., note names). More specifically, for each of the predetermined time intervals the smoothed frequency signal is rounded to a predetermined normalized pitch corresponding to any one of the plurality of musical pitch names determined in semitones (100 cents) (the thus-rounded frequency signal will hereinafter be referred to as "pitch name signal"). In this way, normalized pitches of the input sound signal are detected. Then, in a "convergence curve" process, the detected pitches are converted into a signal continuously varying over time with a characteristic such that, every time the input sound varies in note, it smoothly varies in frequency from the pitch of the last note to the pitch of the new note. Further, in an "output modulation" process, each of the detected pitches of the input sound signal is modulated as appropriate so as to differentiate a pitch of a lead tone to be generated from the original pitch of the input sound. For convenience, in the graph of pitch variation depicted to the right of the rectangular block "output modulation" of FIG. 5, there is shown an example where the detected pitch of the sound signal itself is determined as a pitch of the lead tone to be generated without being subjected to the output modulation.

When adding a harmony tone to a lead tone, on the other hand, any one of pitch names of a twelve-note scale (i.e., note names) is determined in accordance with the pitch detection result of the input sound signal obtained in the aforementioned "pitch name detection" process (or pitch of the lead tone determined on the basis of the pitch detection result) and chord information input via a keyboard or the like and in accordance with the tone pitch determination table of FIG. 6 prepared in advance. Namely, the tone pitch determination table of FIG. 6 has a plurality of sub tables, one sub table per chord, prestored in a ROM, RAM or the like, and one of the sub tables is identified in accordance with chord information input via the keyboard or the like. In FIG. 6, only a sub table for a "C major" chord is shown by way of example. The thus-identified sub table is referenced immediately in response to (in immediate response to) the pitch detection of the input sound signal and on the basis of the pitch detection result, so that a particular pitch corresponding to any one of the musical pitch names is determined as a pitch of a harmony tone. In the tone pitch determination table of FIG. 6, "E0" indicates a note "E" of the same octave as the detected pitch of the lead tone, "C(+1)" indicates a note "C" one octave higher than the detected pitch of the lead tone, and so on. Thus, if the pitch of the lead tone is "E3", then "G3" will be determined as a pitch of a first harmony tone, and "C4" will be determined as a pitch of a second harmony tone.

In the aforementioned manner, output signals of one or more harmony tones are generated by the "convergence curve" process and "output modulation" process being sequentially performed on the basis of pitch name signals comprising pitches corresponding to some of the pitch names of the twelve-note scale determined in accordance with the tone pitch determination table of FIG. 6, like in the generation of the lead tone. Note-on timing of the lead tone and harmony tones is when the pitch of the sound signal has been detected, while note-off timing of the lead tone and harmony tones is when the pitch of the input sound has come to be no longer detected.

As set forth above, the conventionally-known apparatus is constructed to determine a pitch of a harmony tone on the basis of a pitch detection result of an input sound signal (and hence a pitch of a lead tone), from which it can be understood that the pitch of the harmony tone depends on the pitch of the lead tone. So, if the input sound signal is of a human voice and this input sound signal is a signal whose pitch varies while fluctuating up and down beyond a semitone interval like a deep vibrato within a short time period, e.g. a time period from one vowel detection to next vowel detection, a harmony tone whose pitch continuously fluctuates more greatly than fluctuation of a lead tone may be generated. Such a harmony tone is undesirable in that it gives a sense of uncalmness and is uncomfortable to hear. For example, according to the tone pitch determination table shown in FIG. 6, if an input sound signal (and hence a lead tone) represents a vibrato varying between the pitch "E3" and the pitch "F3", then a first harmony tone becomes an output signal with its pitch continuously varying to fluctuate between the pitch "G3" and the pitch "C4". It means that, while the input sound signal varies in pitch by only one semitone, the harmony tone to be added to the lead tone repeats a sound leap with a pitch variation across a pitch interval as great as five semitones within a short time period, and such a harmony tone can hardly be used as an expression to a vibrato.

As another approach for avoiding the aforementioned inconvenience, it is conceivable to lower the frequency of the pitch detection of an input voice signal. However, if the frequency of the pitch detection is lowered, the responsiveness of the harmony tone (additional tone) generation process would undesirably become constantly low, which would result in lowered followability to a chord change and change in other performance conditions. Thus, this approach is unsatisfactory. Further, because the lead tone and harmony tone are each generated on the basis of the pitch detection of the input voice signal, the frequency of not only the harmony tone (additional tone) generation process but also the lead tone generation process would decrease, so that the musical characters, expressiveness, etc. of the input voice signal may be undesirably lost. For this reason too, the above-mentioned approach is unsatisfactory.

SUMMARY OF THE INVENTION

In view of the foregoing, it is an object of the present invention to provide an improved tone signal processing apparatus and method which can avoid the responsiveness of the additional tone generation process response from having to be constantly lowered, and which, even when a pitch variation occurs frequently within a short time period, can generate an additional tone having a sense of auditorily calm stability without involving unwanted pitch fluctuation.

In order to accomplish the above-mentioned object, the present invention provides an improved tone signal processing apparatus, which comprises: an input section which inputs a tone signal; a pitch detection section which sequentially detects a pitch of the tone signal input via the input section; a determination section which determines whether or not there has been a variation in the pitch detected by the pitch detection section; a first tone generation section which generates a first tone signal of a first pitch on the basis of the input tone signal; and a second tone generation section which generates a second tone signal of a second pitch on the basis of the pitch detected by the pitch detection section, where, when the determination section determines that there has been a variation in the pitch, the second tone generation section waits until a predetermined time passes, and the second tone generation section performs control to change the second pitch of the second tone signal if a pitch detected immediately before the variation and a current pitch detected by the pitch detection section are determined to be different from each other upon passage of the predetermined time.

When there has been a variation in the pitch of the input tone signal, the tone signal processing apparatus of the invention waits until the predetermined time passes, without changing the pitch of the second tone signal in immediate response to the pitch variation. Then, if the pitch detected immediately before the pitch variation and the detected current pitch is determined to be different from each other upon the passage of the predetermined time, the tone signal processing apparatus of the invention changes the second pitch of the second tone signal. Namely, according to the present invention, the responsiveness of the second tone signal to the pitch variation of the input tone signal is dulled, so that, even when a pitch variation of the input tone signal has occurred frequently within a short time period, the tone signal processing apparatus of the invention can prevent the second tone signal (additional tone) from unstably fluctuating in immediate response to the pitch variations of the input tone signal. Thus, the tone signal processing apparatus of the invention can generate an additional tone having auditorily calm stability. When there has been no variation in the pitch of the input tone signal, on the other hand, the tone signal processing apparatus of the invention can generate the second tone signal immediately in response to a change of any of other conditions, such as a chord change, and thus, the tone signal processing apparatus of the invention can avoid the responsiveness of the additional tone generation process from having to be constantly lowered.

In a preferred embodiment, the pitch detection section sequentially detects a specific pitch of the input tone signal and sequentially detects, on the basis of the specific pitch, a normalized pitch corresponding to a pitch name. The determination section determines whether or not there has been a variation in the normalized pitch detected by the pitch detection section, and the second tone generation section determines, as the second pitch, a pitch having a given pitch interval from the detected normalized pitch, and generates the second tone signal of the determined second pitch.

In a preferred embodiment, the first tone generation section determines the first pitch on the basis of the pitch detected by the pitch detection section and generates the first tone signal having the determined first pitch.

In such a preferred embodiment, when it is determined that there has been a variation in the pitch of the input tone signal, a process for generating the first tone signal is performed in immediate response to the pitch variation detection, but a process for generating the second tone signal is not performed in immediate response to the pitch variation detection; a wait time is set for the second tone signal generation process. Thus, when there has been a variation in the pitch of the input tone signal, the tone signal processing apparatus of the present invention differentiates timing for generating the first tone signal and timing for generating the second tone signal. Thus, even when a tone signal with a pitch varying while fluctuating up and down like in a vibrato has been input, the tone signal processing apparatus of the present invention can generate the first tone signal without musical characters, expressiveness, etc. of the input tone signal being undesirably lost, but also can generate the second tone signal, which is to be pitch-controlled in response to a pitch variation of the first tone signal, as a tone having a sense of auditorily calm stability.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
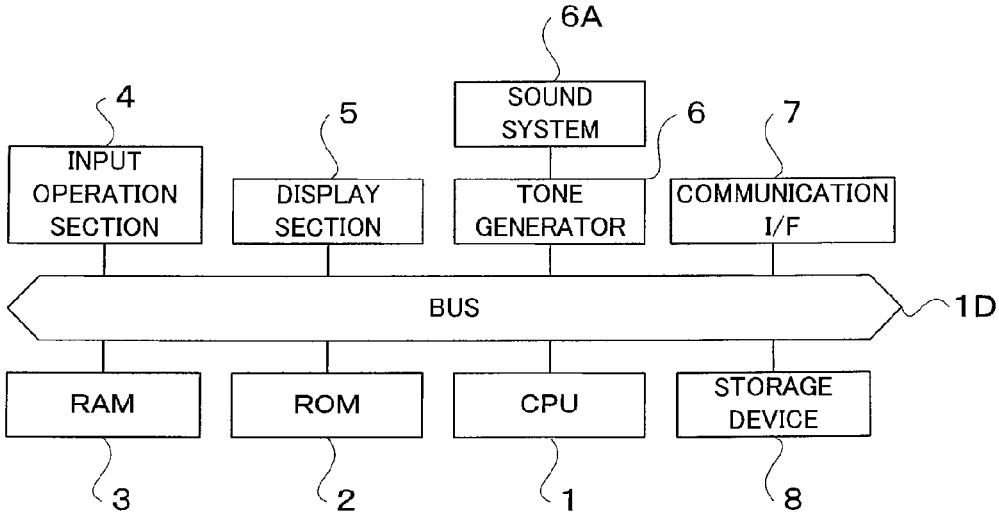
FIG. 1 is a block diagram showing an example general hardware setup of a tone signal processing apparatus in accordance with an embodiment of the present invention.

FIG. 1 is a block diagram showing an example general hardware setup of a tone signal processing apparatus in accordance with an embodiment of the present invention. The tone signal processing apparatus of FIG. 1 is controlled by a microcomputer including a microprocessor unit (CPU) 1, a read-only memory (ROM) 2 and a random access memory (RAM) 3. The CPU 1 controls overall operation of the entire tone signal processing apparatus. To the CPU 1 are connected, via a communication bus (e.g., data and address bus) 1D, the ROM 2, the RAM 3, an input operation section 4, a display section 5, a tone generator 6, a communication interface (IF) and a storage device 8.

Figures 5, 6:
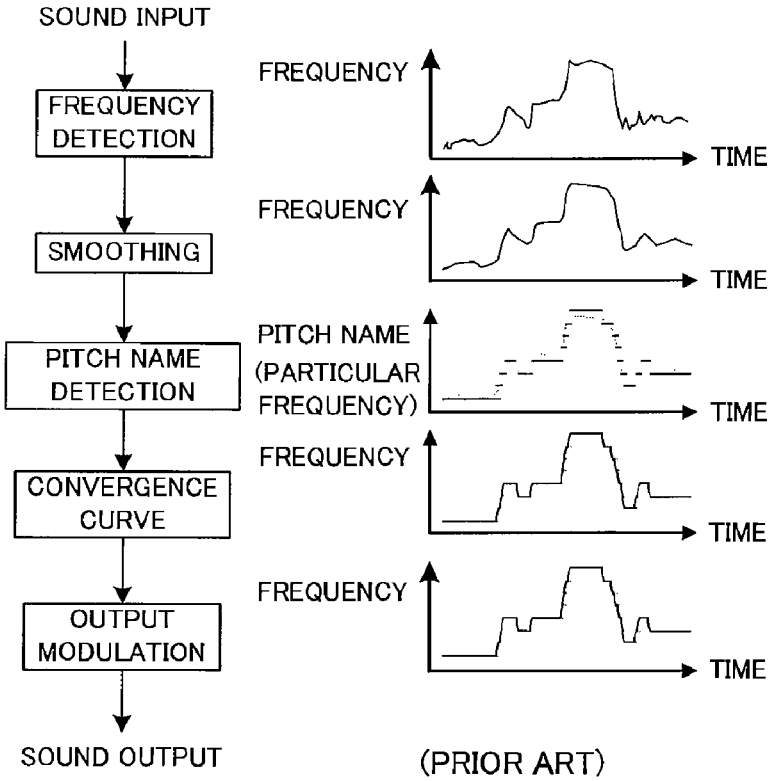
(PRIOR ART) F I G. 5
(PRIOR ART) F I G. 6
FIG. 5 is a conceptual diagram explanatory of a conventionally-known tone signal processing procedure.
FIG. 6 is a conceptual diagram showing a data organization of a conventionally-known tone pitch determination table.

The ROM 2 stores therein various control programs for execution by the CPU 1, and various data, such as a tone pitch determination table shown in FIG. 6, for reference by the CPU 1. The RAM 3 is used as a working memory for temporarily storing various data generated as the CPU 1 executes predetermined programs, as a memory for temporarily storing a currently-executed program and data related to the currently-executed program, and for various other purposes. Predetermined address regions of the RAM 3 are allocated to various functions and used as various registers, flags, tables, memories, etc.

The input operation section 4 may include any of input equipment, such as a microphone for inputting a sound signal, such as a signal of a voice uttered for example by a person, various types of controls like a start/stop button for instructing a start/stop of automatic generation of a harmony tone and switches for setting various parameters, a numerical key pad for entering numerical value data, keyboard for entering letter or text data, a mouse, etc. The input equipment is not limited to a microphone and may be a performance operation unit, such as a keyboard, which generates tone signals of chord tones in response to user's operation, and an input device, such as a sequencer which supplies tone signals, prestored in the ROM 2 or the like, in a predetermined performance progression order.

The display section 5 is, for example, in the form of a liquid crystal display (LCD) panel, CRT and/or the like, and displays various information, such as parameter settings set via various controls, various data currently stored in the ROM 2 and the like, controlling state of the CPU 1, etc.

The tone generator 6, which is capable of simultaneously generating tone signals in a plurality of tone generation channels, generates tone signals of a lead note or tone (i.e., first tone signal), harmony note or tone (i.e., second tone signal), etc., on the basis of a sound signal input, for example, via the microphone (i.e., input tone signal) and supplied via the communication bus 1D to the tone generator 6. Although the sound signal input via the microphone is typically a human voice signal (or vocal sound signal), the input tone signal may be an instrument tone signal generated by a musical instrument or other sound signal. The tone signals generated by the tone generator 6 are audibly generated or sounded via a sound system 6A including an amplifier and speaker. In generating a lead tone, harmony tone, etc., the tone generator 6 can impart the tones with various effects, such as a gender (type and depth of voice quality like that of a male voice or female voice), vibrato (depth and cycle change rate, and delay time to the start of the vibrato), tremolo, tone volume, panning (sound image localization), detune and reverberation. The tone generator 6 and sound system 6A may be constructed in any desired conventionally-known manner. For example, the tone generator 6 may employ any desired tone synthesis method, such as the FM, PCM, physical model or formant synthesis method. Further, the tone generator 6 may be implemented by either dedicated hardware or software processing performed by the CPU 1 or DSP.

The communication interface (I/F) 7 is an interface for communicating various information, such as tone signals, tone pitch determination table and control programs between the tone signal processing apparatus and not-shown external equipment. The communication interface 7 may be a MIDI interface, LAN, Internet, telephone line network or the like. It should be appreciated that the communication interface 7 may be of either or both of wired and wireless types.

The storage device 8 stores therein various information, such as the tone pitch determination table prepared in advance and various control programs for execution by the CPU 1. The storage device 8 may also store therebetween generated tone signals, such as lead tones and harmony tones.

In a case where a particular control program is not prestored in the ROM 2, the control program may be prestored in the storage device (e.g., hard disk device) 8, so that, by reading the control program from the storage device 8 into the RAM 3, the CPU 1 is allowed to operate in exactly the same way as in the case where the particular control program is stored in the ROM 2. This arrangement greatly facilitates version upgrade of the control program, addition of a new control program, etc. The storage device 8 may use any of various removable-type external recording media other than the hard disk (HD), such as a flexible disk (FD), compact disk (CD), magneto-optical disk (MO) and digital versatile disk (DVD); alternatively, the storage device 8 may be a semiconductor memory.

The tone signal processing apparatus of the present invention is not limited to the type where the input operation section unit 4, display section 5, tone generator 6, etc. are incorporated together within the apparatus. For example, the tone signal processing apparatus of the present invention may be constructed in such a manner that the above-mentioned components 4, 5 and 6 are provided separately and interconnected via communication interfaces such as MIDI interfaces, various networks and/or the like.

It should be appreciated that the tone signal processing apparatus and program of the present invention may be applied to any forms of apparatus and equipment, such as karaoke apparatus, electronic musical instruments, personal computers, portable communication terminals like portable phones and game apparatus. In the case where the tone signal processing apparatus and program of the present invention are applied to a portable communication terminal, all of the above-described functions need not be performed by the portable communication terminal alone, in which case the server may have part of the above-described functions so that the above-described functions can be realized by an entire system comprising the terminal and the server.

Figure 2:
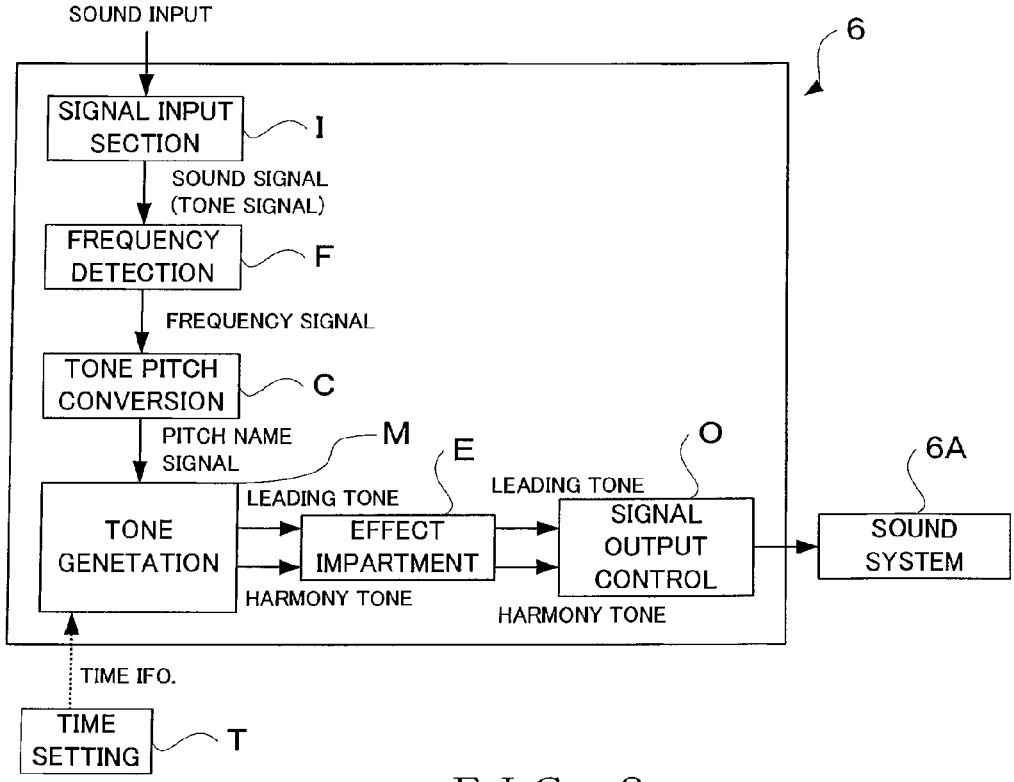
FIG. 2 is a functional block diagram explanatory of a tone generation function of the tone signal processing apparatus of the present invention.

Similarly to the conventionally-known counterpart, the tone signal processing apparatus of the present invention has a tone generation function for: detecting a specific pitch of a tone signal (voice or sound signal) input via the microphone or the like; detecting, on the basis of the detected pitch, a particular normalized pitch corresponding to any one of the musical pitch names (or musical note names); generating, on the basis of the detected normalized pitch, a tone signal of a lead tone (first tone signal) having a first pitch (which is typically identical to the detected normalized pitch); separately determining another or second pitch (corresponding to any one of the musical pitch names similarly to the detected normalized pitch) on the basis of the detected normalized pitch; and then automatically generating a tone signal of a harmony tone (second tone signal) having the determined second pitch. The following explain in more detail the tone generation function performed by the tone signal processing apparatus of the present invention, with reference to FIG. 2 that is a functional block diagram explanatory of the tone generation function performed by the tone signal processing apparatus of the present invention. In FIG. 2, arrows indicate flows of various signals.

As shown in FIG. 2, the tone generator 6 has the tone generation function comprising a signal input section I, a frequency detection section F, a tone pitch conversion section C, a tone generation section M, an effect impartment section E, and a signal output control section O. The signal input section I acquires a tone signal (this tone signal is assumed to be a human voice signal in the following description) input via the microphone or the like, and sequentially or time-serially supplies waveform information of the acquired voice signal to the frequency detection section F. Upon receipt of the voice signal from the signal input section I, the frequency detection section F performs a "frequency detection" (i.e., specific pitch detection) process on the input voice signal to thereby convert the input voice signal into a frequency signal. Then, the frequency detection section F performs a "smoothing" process on the frequency signal to thereby smooth variations of the frequency signal.

The smoothed frequency signal is supplied to the tone pitch conversion section C, and then the tone pitch conversion section C performs a "pitch name detection" process on the smoothed frequency signal to thereby discretize the smoothed frequency signal every predetermined time interval into any one of pitch names of a twelve-note scale (pitch name). In the aforementioned manner, a specific pitch of the input voice signal is detected for each of the predetermined time intervals, and a particular normalized pitch corresponding to any one of the musical pitch names is detected on the basis of the detected specific pitch. Let it be assumed that, in the instant embodiment, the particular normalized pitch corresponding to any one of the musical pitch names, obtained in the aforementioned manner, is determined directly as a pitch of a lead tone (i.e., first pitch). Needless to say, the present invention is not limited to the above-mentioned scheme of determining the normalized pitch detection result of the input voice signal directly as a pitch of a lead tone (first pitch); for example, the normalized pitch detection result of the input voice signal may be subjected to pitch conversion where it is raised or lowered by a predetermined pitch, such as one octave or three semitones, and the thus-pitch converted result may be determined as a pitch of a lead tone (first pitch). In such a case, a pitch of a harmony tone (second pitch) may be determined on the basis of the thus-pitch converted result (first pitch). The aforementioned "frequency detection" process, "smoothing" process and "pitch name detection" process may be similar to those performed in the conventionally-known apparatus, i.e. may be performed using any suitable conventionally-known techniques, and thus, a detailed description about these processes is omitted here.

The particular normalized pitch (pitch name signal), corresponding to any one of the musical pitch names, detected by the tone pitch conversion section C is supplied to the tone generation section M. The tone generation section M has a function as a first tone generation section for generating a lead tone (first tone signal), and a second tone generation section for generating a harmony tone (second tone signal). Upon receipt, from the tone pitch conversion section C, of the particular normalized pitch corresponding to any one of the musical pitch names, the tone generation section M determines a pitch of a lead tone (first pitch) and a pitch of a harmony tone (second pitch) on the basis of the supplied normalized pitch (pitch name signal), and then generates the lead tone (first tone signal) and harmony tone (second tone signal) corresponding to the determined first pitch and second pitch, respectively. The lead tone (first tone signal) and harmony tone (second tone signal) may be generated by the tone generation section M performing, for example, pitch control such that the pitch of the voice signal input via the signal input section I becomes the first and second pitches (pitch name signals). In this case, tone color characteristics of the input voice signal are reflected in both the lead tone (first tone signal) and the harmony tone (second tone signal).

Further, as in the conventionally-known example of FIG. 5, once the input voice changes in note, the determined first pitch (pitch name signal) may be modified, through a "convergence curve" process, into a signal smoothly varying in frequency, and an output signal of the lead note may be generated with such a characteristic that the frequency varies smoothly from the pitch of the last or preceding note to a pitch of a new note. Furthermore, as in the conventionally-known example of FIG. 5, an "output modulation" process may be performed on the frequency signal of the lead note so that the output signal of the lead note, obtained by modulating the pitch of the input voice signal as appropriate, can be generated.

Note that the pitch of the harmony tone (i.e., second pitch) is determined by reference to the pre-prepared tone pitch determination table of FIG. 6 on the basis of the normalized pitch (pitch name signal) of the input voice or the above-mentioned first pitch (pitch name signal) and chord information input via the keyboard or the like. In this case, the number of the pitch of the harmony tone (second pitch) to be determined (i.e., to be sounded simultaneously) may be two or more rather than just one, as seen in FIG. 6. Similarly to the lead tone, the harmony tone (i.e., second tone signal) may be subjected to a "convergence curve" process and "output modulation" process, as in the conventionally-known example of FIG. 5.

However, in the instant embodiment of the invention, timing for changing the pitch of the harmony tone is differentiated depending on whether or not the pitch of the input voice signal (and hence the pitch of the lead tone) has varied.

Namely, if the normalized pitch of the input voice signal, detected by the frequency detection section F every predetermined pitch detection time interval, has not varied as compared to that detected at the last detection time, another harmony tone operation is performed without the harmony tone pitch change, based on the detected pitch variation, being effected, as in the conventionally-known example. For example, even when the normalized pitch of the input voice signal has not changed, the second pitch for the harmony tone can be varied if the chord information, which is another performance condition, has varied. On the other hand, if the normalized pitch of the input voice signal, detected by the frequency detection section F every predetermined pitch detection time interval, has varied as compared to that detected at the last detection time, the instant embodiment waits until a predetermined time passes from the time point at which the pitch variation has been detected, and, if the pitch detected immediately before the pitch variation and the detected current pitch are determined to be different from each other upon the passage of the predetermined time, control is performed to change the second pitch for the harmony tone (second tone signal), unlike in the conventionally-known technique.

Namely, if the pitch of the voice signal has not varied (i.e., if there has been no variation in the pitch of the voice signal), a harmony tone generation process is performed in immediate response to a change in another condition, such as a change in the chord information, is performed, and thus, the harmony tone generation process can be performed without the responsiveness of the harmony tone generation process being lowered. If the pitch of the voice signal has varied (i.e., if there has been a variation in the pitch of the voice signal), on the other hand, the instant embodiment waits until the predetermined time passes. Then, if the pitch detected immediately before the pitch variation has clearly varied or changed to another pitch (including a zero pitch), the control for changing the pitch of the harmony tone is performed, and thus, the responsiveness of the harmony tone generation process to the pitch variation of the voice signal can be lowered or "dulled" as appropriate. In the aforementioned manner, the instant embodiment differentiates the responsiveness of the harmony tone generation process depending on the presence/absence of a pitch variation in the input voice signal. Such a process is implemented with execution of the "tone generation processing". Details of the "tone generation processing" will be discussed later, with reference to FIG. 3.

Referring back to FIG. 2, the above-mentioned "predetermined time", which is a "pitch variation wait time" of a harmony tone to be applied when the pitch of the input voice signal has varied, is supplied as time information from a time setting section T to the tone generation section M. This time information may be in the form of suitable information indicative of a time length itself, such as 60 ms, or a musical symbol capable of indicating a time length, such as a thirty-second note, and the time information may be of either a fixed value or a value that may be set (designated) as desired by the user. Alternatively, the time information may be indicative of any one of various time lengths predetermined in association with possible intensities or degrees of the pitch variation (namely, pitch differences or intervals between pitches before and after pitch the pitch variation) of the input voice signal. In the case where the time length to be indicated by the time information is determined in accordance with a pitch difference or interval, correspondence relationship between pitch differences and time lengths may be prestored as a table or the like; for example, in such a table, a thirty-second note may be stored for a pitch difference equal to or smaller than three degrees, a thirty-second note plus 10 ms for a pitch difference greater than three degrees but not greater than five degrees, a thirty-second note plus 20 ms for a pitch difference greater than five degrees. Alternatively, the time length may be determined using some calculation expression in accordance with which the time length increases by 10 ms each time the pitch difference increases by two degrees, instead of the correspondence relationship being stored as a table. Such a scheme is convenient in that it can adjust the harmony tone generation timing in accordance with a detected pitch variation degree of the input voice signal.

The lead tone and/or harmony tone generated by the tone generation section M in the aforementioned manner is supplied to the effect impartment section E, so that any of various effects, such as gender, vibrato, tremolo, sound volume, panning, detune and reverberation, can be imparted to the lead tone and/or harmony tone by means of the effect impartment section E. The output control section O outputs the lead tone and/or harmony tone, supplied from the effect impartment section E, to the sound system 6A. At that time, the output control section O can selectively output only the lead tone, only the harmony tone, or both of the lead tone and harmony tone.

Next, a description will be given about the function of the tone generation section M, i.e. the "tone generation processing" for generating a lead tone and/or harmony tone, with reference to FIG. 3 that is a flow chart showing an example operational sequence of the "tone generation processing". The "tone generation processing" is started up, for example, in response to the start of automatic generation of a harmony tone being instructed by user's operation of the start/stop button, and then the "tone generation process" is performed, as interrupt processing, every predetermined time, such as 10 ms, until the stop of the automatic generation of the harmony tone is instructed.

At step S1, a determination is made as to whether there has been a pitch variation in a pitch detection result of an input voice signal (or in a pitch of a lead tone determined in accordance with the pitch detection result of the input voice signal), or whether a particular pitch, corresponding to any one of the musical pitch names, detected by the tone pitch conversion section C, has differed from that detected at the last execution of the tone generation processing. If the input voice signal is of a human voice, the determination as to presence/absence of a pitch variation at step S1 can be made during a time period from detection of a vowel to detection of a next vowel as known in the art.

If there has been a pitch variation in the pitch detection result of the input voice signal as determined at step S1 (i.e., YES determination at step S1), the tone generation processing goes to step S2 in order to instruct to generate a lead tone with such a continuous (smooth) pitch variation as to approach a varied-to pitch (i.e., pitch immediately after the pitch variation). Because the process for generating a lead tone smoothly varying in pitch in response to the pitch variation of the input voice is similar to the conventionally-known counterpart, a detailed description of the process is omitted. In the instant embodiment, a speed at which the pitch should be caused to approach to the varied-to pitch (i.e., pitch immediately after the pitch variation) may be set as appropriate by the user. It should be noted that the pitch of the lead tone may be changed to the varied-to pitch immediately without performing such a continuous (smooth) pitch variation control mentioned above.

At step S3, the tone generation section M starts counting time, and sets a count start flag to "1". As described later, at this time, the tone generation section M may store the current pitch detection result (i.e., current pitch of the lead tone). Note, however, the time counting is started only if a time counter value has been cleared. Namely, this step S3 is jumped over after the time counting has been started. At next step S4, a determination is made as to whether the counter value has passed a predetermined setting time based on time information supplied from the time setting section T (see FIG. 2) (i.e., the "predetermined time" that is a pitch variation wait time of a harmony tone). If the counter value has not passed the setting time as determined at step S4 (NO determination at step S4), then the tone generation processing of FIG. 3 is brought to an end. Namely, before the time counter value passes the setting time, the tone generation processing does not cause a pitch variation of a harmony tone to be effected in immediate response to the detection of the pitch variation of the input voice, by ignoring the pitch variation of the input voice (or lead tone). Let it be assumed that, at the start of the time counting, i.e. when a pitch variation has been detected, at least one of pitch information Pa immediately before the pitch variation (i.e., pre-variation pitch information Pa) and varied pitch information Pb is retained in a suitable register.

Then, once the setting time passes (YES determination at step S4), the time counter value is cleared at step S5 and the count start flag Fc is reset to "0". At next step S6, an operation for re-determining the pitch variation is performed; namely, at this step, a determination is made as to whether the pitch immediately before the variation and the detected current pitch are different from each other. For example, in this re-determination operation, information Pc indicative of the detected current pitch is acquired from the tone pitch conversion section C, and a comparison is made between the current pitch information Pc and the pre-variation pitch information Pa or varied pitch information Pb retained in the above-mentioned register. If Pc≠Pa or Pc=Pb, it is determined that the pre-variation pitch and the detected current pitch are different from each other. If it is determined that the pre-variation pitch and the detected current pitch are different from each other, the tone generation processing proceeds to S7, while, if it is determined that the pre-variation pitch and the detected current pitch are not different from each other, the tone generation processing jumps over step S7 to be brought to an end. At step S7, a harmony tone (additional tone) is generated on the basis of a newly-acquired pitch detection result of the input voice signal; namely, control is performed to change the pitch of the harmony tone. Thus, even if there has occurred a variation in the pitch detection result of the voice signal during a time period before the setting time passes, the tone generation processing does not cause a harmony tone to be generated in immediate response to the detection of the pitch variation of the input voice signal, before the setting time passes or lapses.

Figure 4A:
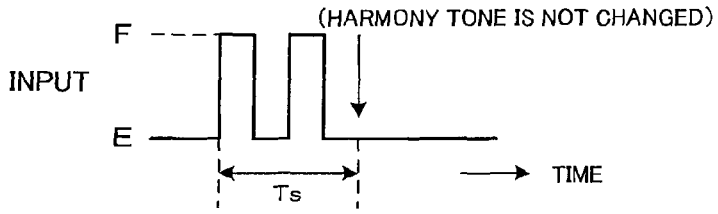
FIGS. 4A and 4B are timing charts showing examples of generation operation of a harmony tone according to an embodiment of the present invention.
Figure 4B:
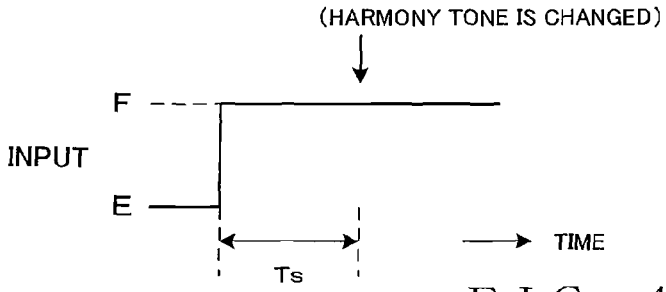

Namely, according to the embodiment described above, even if the normalized pitch of the input voice signal is temporarily changed from a first note (E) to a second note (F) during the time period before the setting time (Ts) passes, as shown for example in FIG. 4A, the pitch of the harmony tone is not changed if the normalized pitch of the input voice signal has returned to the first note (E) at the time the setting time (Ts) has passed. However, if the normalized pitch of the input voice signal is changed from a first note (E) to a second note (F) and still kept at the same second note (F) at the time the setting time (Ts) has passed, as shown for example in FIG. 4B, the pitch of the harmony tone is changed to an appropriate note corresponding to the second note (F). The lead tone, on the other hand, is changed in response to the pitch variation in the normalized pitch of the input voice signal in both of the cases of FIGS. 4A and 4B.

Figure 3:
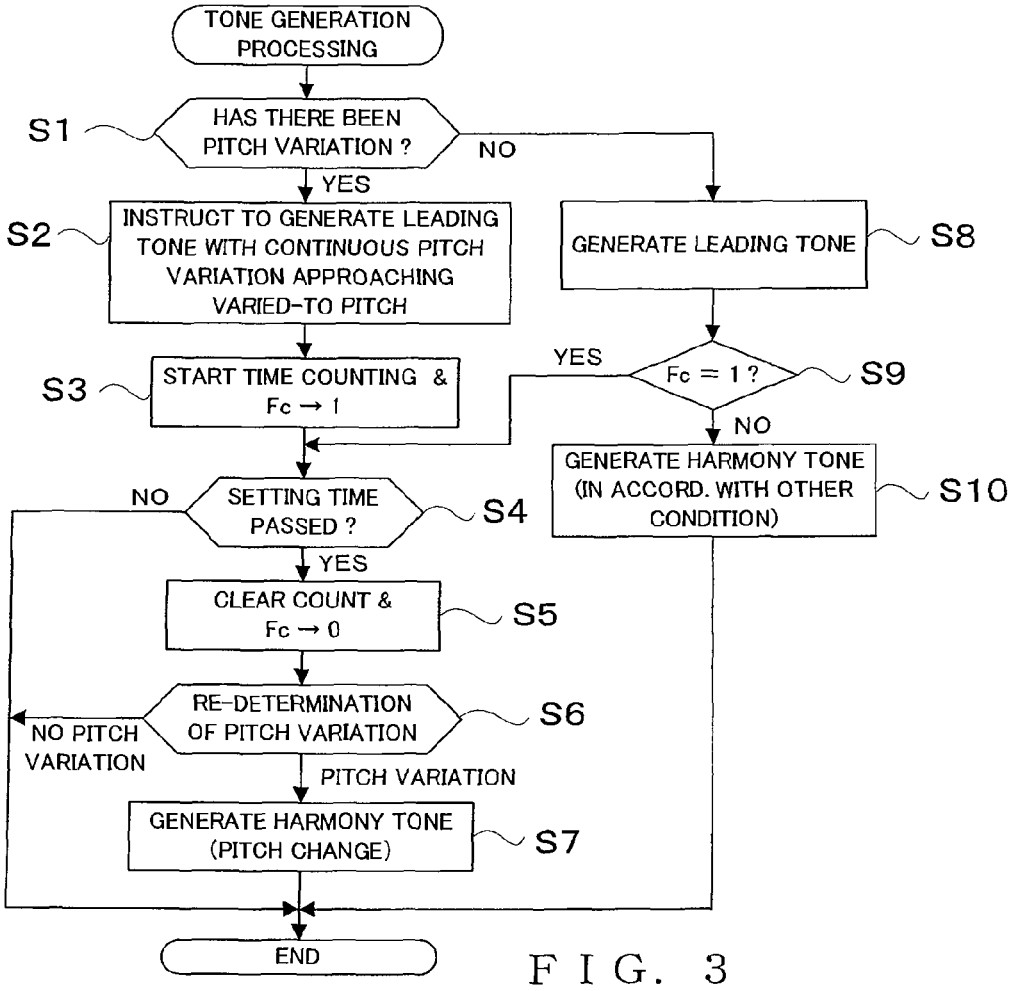
FIG. 3 is a flow chart showing an example operational sequence of tone generation processing performed in the tone signal processing apparatus.

Reverting to FIG. 3, if there has been no pitch variation in the pitch detection result as determined at step S1 (i.e., NO determination at step S1), generation of a lead tone having a particular pitch, corresponding to the musical pitch names, detected by the tone pitch conversion section C are continued at step S8, or a lead tone having a smoothly-varying pitch approaching the varied-to pitch according to the instruction issued at the step S2 are generated. Then, at step S9, it is determined whether the flag Fc is "1" or not. If the flag Fc is "1", it means that the setting time has not yet passed, and thus, the process goes to the step S4. If the flag Fc is "0", it means that the setting time has passed, and thus, the process goes to step S10. At the step S10, a harmony tone (additional tone) is formed in accordance with an appropriate condition, e.g., a condition other than a pitch. Because the respective processes for generating the lead tone and harmony tone at steps S8 and S10 may be similar to the conventional counterparts, a detailed description of the generation processes is omitted here. In the instant embodiment, as noted above, if there has been no pitch variation, the harmony tone is formed or controlled immediately in response to the pitch detection of the input voice signal and on the basis of the pitch detection result, like in the conventionally-known apparatus.

As set forth above, when a pitch detection result of an input voice signal is indicating a pitch variation from the last detected pitch, the tone signal processing apparatus of the present invention does not generate a harmony tone in immediate response to the pitch detection of the input voice signal and on the basis of the pitch detection result as done in the conventionally-known apparatus. Namely, if there has been such a pitch variation, the tone signal processing apparatus of the present invention generates a harmony tone on the basis of a result of pitch detection of the voice signal that is performed again after the setting time has passed from the pitch detection time point of the voice signal. Namely, in the tone signal processing apparatus of the present invention, the generation timing of a lead tone and harmony tone to be generated when there has been a pitch variation in an input voice signal is differentiated from that employed in the conventionally-known apparatus. In this way, the tone signal processing apparatus of the present invention can generate a harmony tone that has a sense of auditorily calm stability even when a voice signal whose pitch varies while fluctuating up and down like in a vibrato has been input. Further, because the frequency of the pitch detection of an input voice signal need not be lowered in the present invention, the frequency at which to generate a lead tone can be the same as in the conventionally-known apparatus, and thus, the present invention can prevent unwanted loss of musical characters, expressiveness, etc. of the input voice signal.

Whereas the embodiment of the present invention has been described above in relation to the case where a tone signal, on the basis of which a lead tone and harmony tone are to be generated, is of a voice input via the microphone, such a tone signal may be of a tone generated by a musical instrument and input via the microphone. In the case where the tone signal is of a tone generated by a musical instrument and input via the microphone, the additional tone may be one or more accompaniment tones. A plurality of, rather than just one, of such harmony tones may be generated simultaneously. In such a case, each harmony tone is determined to be different in pitch from the other harmony tone, as shown in FIG. 6.

Note that the chord information to be input for generation of a harmony tone may be one detected from among information input from the performance operation unit, such as a keyboard, provided on or connected to the tone signal processing apparatus of the present invention, or one obtained from among sequentially-input chord names.

Further, whereas the above-described embodiment is constructed to generate a harmony tone on the basis of chord information, the present invention is not so limited and may employ any other conventionally-known method where a harmony tone is generated in a suitable manner rather than on the basis of chord information. For example, the present invention may employ a method of generating a harmony tone with a pitch kept at a predetermined pitch interval (e.g., three or more degrees) from a lead tone.

Furthermore, whereas the tone generation section M in the above-described embodiment is constructed to generate, as a lead tone (first tone signal), a tone obtained by pitch-controlling a pitch of an input voice signal to become a first pitch (pitch name signal) supplied from the tone pitch conversion section C, the present invention is not so limited, and the voice signal input via the signal input section I may be generated directly as a lead tone (first tone signal).

Further, the embodiment has been described as generating a lead tone (first tone signal) and harmony tone (second tone signal) having tone color characteristics of a voice signal input via the signal input section I by pitch-controlling the input voice signal. However, the present invention is not so limited, and a lead tone (first tone signal) and/or harmony tone (second tone signal) may be generated by pitch-controlling a waveform of desired tone color characteristics.

This application is based on, and claims priority to, JP PA 2009-238082 filed on 15 Oct. 2009. The disclosure of the priority application, in its entirety, including the drawings, claims, and the specification thereof, is incorporated herein by reference.

What is claimed is:

1. A tone signal processing apparatus comprising:

an input section which inputs a tone signal;

a pitch detection section which sequentially detects a pitch of the tone signal input via said input section;

a determination section which determines whether or not there has been a variation in the pitch detected by said pitch detection section;

a first tone generation section which generates a first tone signal of a first pitch on the basis of the input tone signal; and a second tone generation section which generates a second tone signal of a second pitch on the basis of the pitch detected by said pitch detection section, where, when said determination section determines that there has been a variation in the pitch, said second tone generation section waits until a predetermined time passes, and said second tone generation section performs control to change the second pitch of the second tone signal if a pitch detected immediately before the variation and a current pitch detected by said pitch detection section are determined to be different from each other upon passage of the predetermined time.

2. The tone signal processing apparatus as claimed in claim 1, wherein said pitch detection section sequentially detects a specific pitch of the input tone signal and sequentially detects, on the basis of the specific pitch, a normalized pitch corresponding to a pitch name, said determination section determines whether or not there has been a variation in the normalized pitch detected by said pitch detection section, and said second tone generation section determines, as the second pitch, a pitch having a given pitch interval from the detected normalized pitch, and generates the second tone signal of the determined second pitch.

3. The tone signal processing apparatus as claimed in claim 1, wherein said first tone generation section determines the first pitch on the basis of the pitch detected by said pitch detection section and generates the first tone signal having the determined first pitch.

4. The tone signal processing apparatus as claimed in claim 3, wherein said first tone generation section generates, as the first tone signal, a tone signal obtained by changing the pitch of the input tone signal to the first pitch.

5. The tone signal processing apparatus as claimed in claim 1, wherein said first tone generation section generates the input tone signal directly as the first tone signal.

6. The tone signal processing apparatus as claimed in claim 1, wherein said second tone generation section generates, as the second tone signal, a tone signal obtained by changing the pitch of the input tone signal to the second pitch.

7. The tone signal processing apparatus as claimed in claim 1, wherein said second tone generation section determines the second pitch on the basis of the pitch detected by said pitch detection section and chord information.

8. The tone signal processing apparatus as claimed in claim 1, which further comprises an output section constructed to selectively output at least one of the first and second tone signals.

9. The tone signal processing apparatus as claimed in claim 1, which further comprises a time setting section constructed to variably set the predetermined time.

10. The tone signal processing apparatus as claimed in claim 9, wherein said time setting section is capable of adjusting the predetermined time according to a user's operation.

11. The tone signal processing apparatus as claimed in claim 9, wherein said time setting section acquires information indicative of a variation amount of the pitch detected by said pitch detection section, and said time setting section is capable of adjusting the predetermined time in accordance with the acquired variation amount.

12. The tone signal processing apparatus as claimed in claim 1, wherein said input section includes a microphone.

13. The tone signal processing apparatus as claimed in claim 1, wherein the tone signal input via said input section is at least one of a human voice signal, an instrument tone signal generated by a musical instrument and other sound signal.

14. A computer-implemented method for generating an additional tone corresponding to an input tone signal, said method comprising:

an input step of inputting a tone signal;

a detection step of sequentially detecting a pitch of the tone signal input via said input step;

a determination step of determining whether or not there has been a variation in the pitch detected by said detection step;

a first tone generation step of generating a first tone signal of a first pitch on the basis of the input tone signal; and a second tone generation step of generating a second tone signal of a second pitch on the basis of the pitch detected by said detection step, where, when said determination step determines that there has been a variation in the pitch, said second tone generation step waits until a predetermined time passes, and said second tone generation step performs control to change the second pitch of the second tone signal if a pitch detected immediately before the variation and a current pitch detected by said pitch detection step are determined to be different from each other upon passage of the predetermined time.

15. A computer-readable storage medium containing a program for causing a processor to perform a method for generating an additional tone corresponding to an input tone signal, said method comprising:

an input step of inputting a tone signal;

a detection step of sequentially detecting a pitch of the tone signal input via said input step;

a determination step of determining whether or not there has been a variation in the pitch detected by said detection step;

a first tone generation step of generating a first tone signal of a first pitch on the basis of the input tone signal; and a second tone generation step of generating a second tone signal of a second pitch on the basis of the pitch detected by said detection step, where, when said determination step determines that there has been a variation in the pitch, said second tone generation step waits until a predetermined time passes, and said second tone generation step performs control to change the second pitch of the second tone signal if a pitch detected immediately before the variation and a current pitch detected by said pitch detection step are determined to be different from each other upon passage of the predetermined time.

* * * * *